US008061486B2

(12) United States Patent
Monzon et al.

(10) Patent No.: US 8,061,486 B2
(45) Date of Patent: Nov. 22, 2011

(54) ELEVATOR SAFETY SYSTEMS INCLUDING DETECTION OF AN OBJECT IN THE HOISTWAY

(75) Inventors: Andrés Monzon, Madrid (ES); Ricardo Cano, Madrid (ES); Armondo Serviá, Madrid (ES); Jose Cabellero, Madrid (ES)

(73) Assignee: Otis Elevator Company, Farmington, CT (US)

( * ) Notice: Subject to any disclaimer, the term of this patent is extended or adjusted under 35 U.S.C. 154(b) by 1155 days.

(21) Appl. No.: 11/793,287

(22) PCT Filed: Dec. 21, 2004

(86) PCT No.: PCT/IB2004/004249

§ 371 (c)(1),
(2), (4) Date: Jun. 14, 2007

(87) PCT Pub. No.: WO2006/067542

PCT Pub. Date: Jun. 29, 2006

(65) Prior Publication Data

US 2011/0094832 A1 Apr. 28, 2011

(51) Int. Cl.
*B66B 1/34* (2006.01)

(52) U.S. Cl. ..... 187/392; 340/541

(58) Field of Classification Search ..... 187/247, 187/391–395; 340/541, 545.3, 545.6

See application file for complete search history.

(56) References Cited

U.S. PATENT DOCUMENTS

| | | | | |
|---|---|---|---|---|
| 5,025,895 | A * | 6/1991 | Leone et al. | 187/277 |
| 5,283,400 | A * | 2/1994 | Leone et al. | 187/391 |
| 5,347,094 | A * | 9/1994 | Leone et al. | 187/390 |
| 6,050,369 | A * | 4/2000 | Leone et al. | 187/392 |
| 6,550,585 | B2 * | 4/2003 | Schoppa et al. | 187/391 |
| 6,603,398 | B2 * | 8/2003 | Tinone et al. | 340/541 |
| 7,201,256 | B2 | 4/2007 | Deplazes et al. | |

FOREIGN PATENT DOCUMENTS

EP 1167268A1 A1 1/2002

* cited by examiner

*Primary Examiner* — Anthony Salata
(74) *Attorney, Agent, or Firm* — Carlson, Gaskey & Olds PC

(57) ABSTRACT

An elevator system has a hoistway (4) and an elevator car (2) arranged to travel vertically within the hoistway, the hoistway is provided with a sensing arrangement such as an infrared curtain (10, 12) for detecting the presence of a person on top of the car as the car approaches the top of the hoistway (8). The elevator system is arranged to limit further upward movement of the car in the event that a person is detected.

24 Claims, 2 Drawing Sheets

ELEVATOR SAFETY SYSTEMS INCLUDING DETECTION OF AN OBJECT IN THE HOISTWAY

BACKGROUND

This invention relates to enhancements in the safety of elevators, particularly the detection of the unauthorised presence of a person on top of an elevator car.

It is becoming increasingly common in elevator installations to provide very little space above the ordinary travel of the elevator car as this reduces building costs and increases the available flexibility in building design. However, there is a risk of injury in low overhead elevator installations as there is less refuge space for a person riding on top of the elevator car as the car approaches the uppermost landing. It is therefore necessary to provide a series of safety systems such as a retractable balustrade and a special inspection mode for the elevator controller which prevent the car from travelling to the top of the hoistway. These permit authorised inspections to be carried out safely by an engineer riding on top of the car. However, if these safety measures are not all properly employed or are inadvertently or deliberately overridden, there is an increased risk of injury. This could result from an engineer not adhering to an approved procedure for carrying out inspection or could result from an unauthorised person gaining access to the top of the car.

SUMMARY

In view of the above, it is desirable automatically to prevent the elevator car moving to the uppermost end of its travel if a person is present on top of the car.

When viewed from a first aspect the present invention provides an elevator system comprising a hoistway and an elevator car arranged to travel vertically within the hoistway, the hoistway being further provided with a sensing arrangement for detecting the presence of a person on top of the car as the car approaches the top of the hoistway, the elevator system being arranged so as to limit further upward movement of the car in the event that a person is detected.

When viewed from a second aspect the invention provides a method of preventing injury to a person riding on top of an elevator car in a low-overhead elevator system the method comprising detecting the presence of a person on top of the car as the car approaches the top of a hoistway using means provided in the hoistway and limiting further upward movement of the car in the event that a person is detected.

Thus it will be seen by those skilled in the art, that in accordance with the invention a person at risk of being injured at the top of the hoistway as the elevator car moves up will be detected and the elevator system will limit upward movement of the car to reduce the risk of injury to that person.

The means for detecting a person on top of the car could be one that is able to distinguish between a living person and an inanimate object so that it does not sense the presence of the car itself during normal operation. For example, the sensing arrangement could comprise a passive infrared sensor for sensing the body heat of the person on top of the car. Preferably, however, the sensing arrangement is adapted to detect the presence of an object at the relevant vertical point of the hoistway.

A point in the hoistway above the normal travel of the elevator could be chosen but in very low overhead installations this may not give sufficient distance in which to stop the car safely without causing injury to the person on top of it. In accordance with preferred embodiments therefore the sensing point is within the normal travel of the car and the elevator system is arranged to be able to distinguish between a person riding on top of the car and the car itself having traveled to the vertical sensing point during normal operation. Whilst there are many ways of achieving this, it is preferred to use an existing position reference system to determine the position of the car and to limit upward movement of the car in accordance with the invention only if it is determined via the position reference system that the elevator car is not intended to be in a position where it will be detected by the sensing arrangement. One way of doing this would be for the sensing arrangement to send a signal to the elevator controller and for the elevator controller to be arranged to limit upward movement of the car based on the signals from the sensing arrangement and the position reference system.

Alternatively, the sensing arrangement may be enabled when the elevator car is towards the top of the hoistway but still low enough that there is sufficient space between the top of the car and the top of the hoistway to accommodate a person. For example, the sensing arrangement could be activated when the elevator car is at the landing below the uppermost landing. By positioning the sensing arrangement above the position of the elevator car when the sensing arrangement is activated, the sensing arrangement will only detect an object on top of the car rather than the car itself. Of course, if the position of the sensing arrangement is such that it will be passed by the elevator car during normal operation, this should not set off the safety system to limit movement of the car. One possibility would be for a second position signal to be used to deactivate the sensor. Alternatively the sensing arrangement could be enabled when the elevator car is above the penultimate landing a time measurement made to determine whether an object is detected before it would be expected for the car itself to be detected.

Upon detection of an unauthorised person on top of the car there are a number of possibilities for taking action to prevent injury to that person. For example the elevator controller may immediately prevent any further upward movement of the car by interrupting power to the elevator motor and applying the brake. Additionally, or alternatively, a physical safety device may be automatically employed.

In a preferred set of embodiments the sensing arrangement comprises means for emitting a sensing radiation and means for detecting the emitted radiation so as to enable the presence of an object in the path of the radiation to be detected. The sensing arrangement could be such that radiation reflected from the detected body is sensed but preferably the arrangement is such that the radiation travels across the hoistway to be detected so that the presence of a body at that vertical point in the hoistway interrupts the sensing of the radiation. Most preferably the sensing arrangement comprises a plurality of beams spanning the hoistway and one or more sensors arranged to detect said beam(s).

The radiation employed may be of any convenient nature such as ultrasound, microwave or visible light but preferably infrared radiation is employed since the associated sensors and emitters are relatively easily available and inexpensive whilst being reliable.

BRIEF DESCRIPTION OF THE DRAWINGS

A preferred embodiment of the present invention will now be described, by way of example only with reference to the accompanying drawings in which.

DETAILED DESCRIPTION

Figure 1:
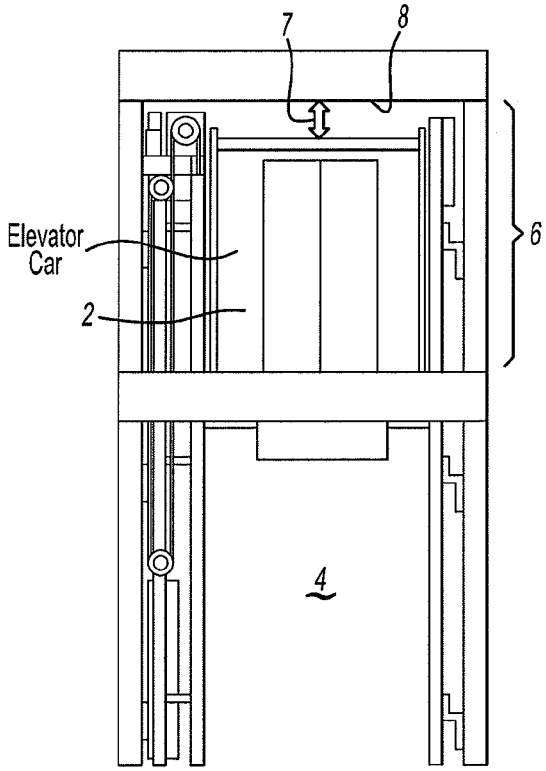
FIG. 1 is a front view of a low overhead elevator hoistway showing the danger posed to persons on top of the car.
Figure 2A:
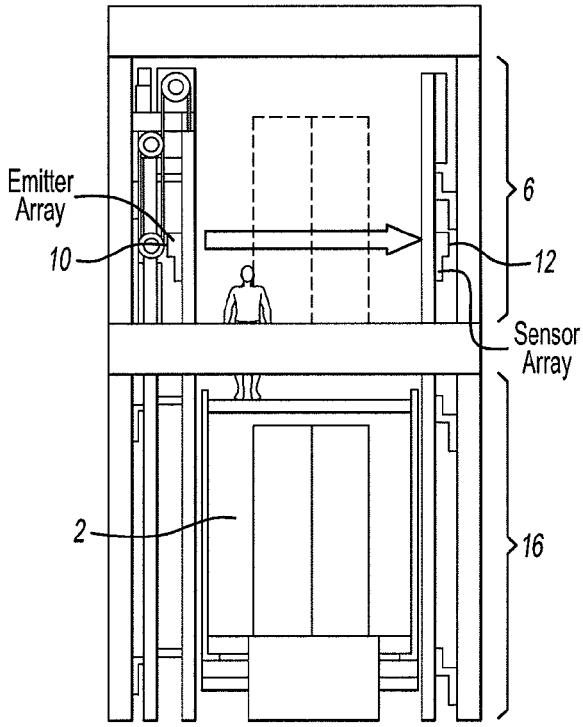
FIGS. 2*a* and 2*b* are front and perspective views respectively of an elevator system embodying the invention showing activation of the infrared curtain.
Figure 2B:
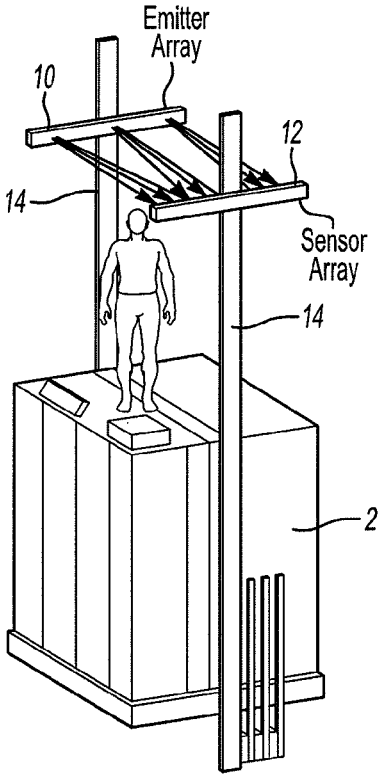
Figure 3A:
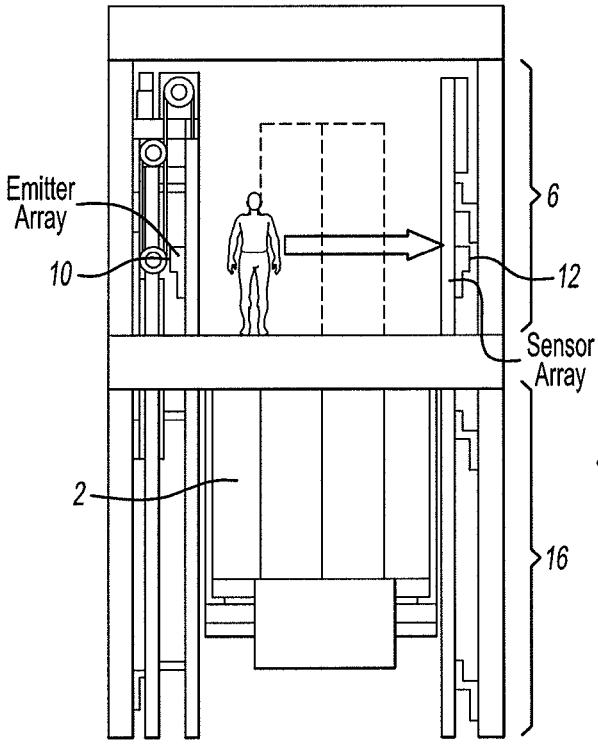
FIGS. 3*a* and 3*b* are front and perspective views respectively showing detection of an unauthorised person on top of the car.
Figure 3B:
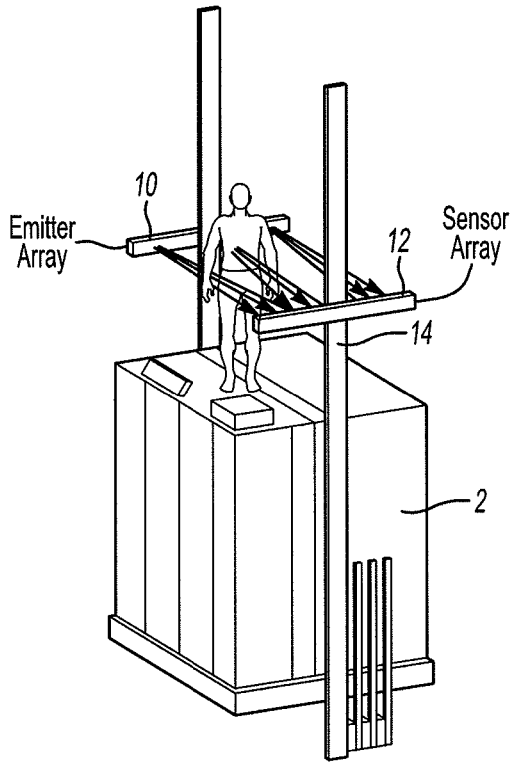
Figure 4:
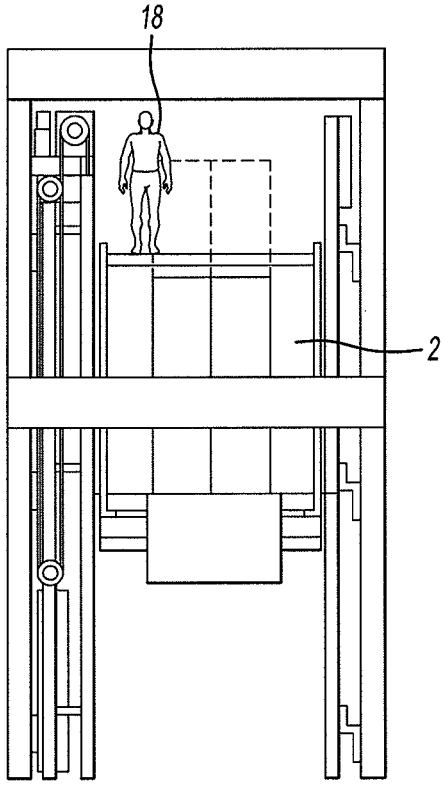
FIG. 4 is a front view of the embodiment of FIGS. 2 and 3 where the car is safely stopped to prevent injury to the person on top of the car.

FIG. 1 shows an elevator car 2 which is arranged to move vertically within a hoistway 4. It will be seen that when the car 2 is adjacent the uppermost landing 6 there is very little space 7 between the top of the car 2 and the ceiling 8 of the hoistway. In particular, there is no refuge space for a person who happens to be on top of the car.

In low overhead systems such as that shown, a series of safety measures is required to ensure that the car cannot reach the uppermost landing 6 with someone riding on top of it. Normally such systems are linked to certain conditions like putting the elevator in a special inspection mode or the detection of unauthorised opening of a hoistway door indicating access to the top of the car by an unauthorised person.

However, it is not impossible that detection elements can be overridden or the elevator not properly put into inspection mode. Specifically, a door detection system can be overridden by an unauthorised user who can then ride on top of the car in normal mode. As will be seen from FIG. 1, this is extremely dangerous and potentially fatal. This may be prevented in accordance with the invention as will now be described with reference to FIGS. 2 to 5.

According to the embodiment of the invention described herein, in the uppermost part of the hoistway 2 there is provided an infrared sensor and emitter arrangement comprising an elongate emitter array 10 and a corresponding elongate sensor array 12 disposed horizontally within the elevator shaft by being attached to the respective guide rails 14. In the embodiment shown in the Figures the emitter array 10 comprises a plurality of separate emitters which emit-infrared beams spanning the hoistway at a number of different angles to be sensed by a corresponding plurality of sensors at the sensor array 12 on the other side of the hoistway. By having a plurality of independent emitters and sensors the probability of spurious detection e.g. from small pieces of debris or flying insects in the hoistway may be reduced. However, it is envisaged that a single beam could be employed which could span the hoistway just once or alternatively which could be reflected one or more times to provide a greater spatial extent.

It will be seen that the sensor and emitter arrays 10,12 are provided approximately one third of the way up the uppermost landing space 6. The sensing arrangement 10,12 is activated when the elevator car 2 is adjacent the landing 16 below the uppermost landing 6. As will be seen now with reference to FIGS. 3A and 3B, as the elevator car moves up beyond the penultimate landing 16 the unauthorised person 18 on top of the car will break the infrared beam between the emitter array 10 and the sensor array 12 which will be detected by the sensor array 12 as an interruption to its signal. Once this has been detected, further upward movement of the elevator car 2 will be prevented and the brake will be applied. As may be seen in FIG. 2A, this means that enough space remains above the top of the car 2 to prevent injury to the unauthorised person 18 on top of the car. The system could be arranged so as to require a manual reset e.g. by an authorised engineer before it may recommence normal operation although this is not essential.

If there is no unauthorised person on top of the car, the top of the car itself will eventually break the beam between the emitter array 10 and sensor array 12 as the car moves up to the uppermost landing 6. However, this does not lead to suspension of operation of the car since the position reference system (PRS) signal indicates that the car is expected to be at a position such that it breaks the beam.

It will be appreciated by those skilled in the art that variations and modifications to the described embodiment may be made without departing from the scope of the invention. For example, other means for sensing the presence of a person on top of the car may be provided such as visible light, ultrasonic, microwave or other sensors. Moreover timing signals could be used rather than position signals to distinguish between the car and an unauthorised person on top of it.

The invention claimed is:

1. An elevator system comprising:

a hoistway;

an elevator car situated to travel vertically within the hoistway; and a sensing arrangement provided in the hoistway, wherein the sensing arrangement detects the presence of an object on top of the car at a predetermined vertical point of the hoistway as the car is moving and approaches a top of the hoistway, wherein said predetermined vertical point is within a normal travel range of the elevator car, wherein the elevator system: (a) limits further upward movement of the car in the event that an object is detected at the predetermined vertical point; and (b) distinguishes between an object riding on top of the car and the car itself having traveled to said point during normal operation.

2. The elevator system as claimed in claim 1, wherein the elevator system uses a position reference system to determine the position of the car and limits upward movement of the car only if it is determined, via the position reference system, that the elevator car is not intended to be in a position where it will be detected by the sensing arrangement.

3. The elevator system as claimed in claim 2, wherein said sensing arrangement sends a signal to an elevator controller, and wherein the elevator controller limits upward movement of the car based on said signal and an output from the position reference system.

4. The elevator system as claimed in claim 1, wherein the sensing arrangement is enabled when the elevator car is towards the top of the hoistway but still low enough that there is sufficient space between the top of the car and the top of the hoistway to accommodate a person.

5. The elevator system as claimed in claim 1, wherein the sensing arrangement is enabled, in use, when the elevator car is at a landing below an uppermost landing.

6. The elevator system as claimed in claim 1, further comprising:

means for generating a position signal for disabling said sensing arrangement as the sensing arrangement is approached by the car.

7. The elevator system as claimed in claim 1, further comprising:

means for immediately preventing any further upward movement of the car upon detection of an unauthorized person on top of the car.

8. The elevator system as claimed in claim 1, further comprising:

means for automatically activating a physical safety device upon detection of an unauthorized person on top of the car.

9. The elevator system as claimed in claim 1, wherein the sensing arrangement comprises:

means for emitting a sensing radiation; and means for detecting the emitted radiation so as to enable the presence of an object in the path of the radiation to be detected.

10. The elevator system as claimed in claim 9, wherein the sensing arrangement is such that the radiation is configured to travel substantially horizontally across the hoistway.

11. The elevator system as claimed in claim 9, wherein said radiation comprises infrared radiation.

12. The elevator system as claimed in claim 1, wherein the sensing arrangement comprises:

a plurality of beams spanning the hoistway; and one or more sensors arranged to detect said beam(s).

13. The elevator system as claimed in claim 12, wherein said beams comprise infrared radiation.

14. A method of preventing injury to a person riding on top of an elevator car in a low-overhead elevator system, the method comprising the steps of:

distinguishing between an object riding on top of the car and the car itself;

detecting the presence of the object on top of the car, at a predetermined vertical point of the hoistway, as the car is moving and approaches the top of a hoistway using a sensing arrangement provided in the hoistway; and limiting further upward movement of the car when the object is detected.

15. The method as claimed in claim 14, further comprising the steps of:

determining, using a position reference system, the position of the car; and limiting upward movement of the car only if it is determined, via the position reference system, that the elevator car is not intended to be in a position where it will be detected by the sensing arrangement.

16. The method as claimed in claim 15, further comprising the steps of:

sending a signal to an elevator controller; and limiting, by means of the elevator controller, further upward movement of the car based on said signal and an output from the position reference system.

17. The method as claimed in claim 14, further comprising the step of:

enabling the sensing arrangement when the elevator car is towards the top of the hoistway but still low enough that there is sufficient space between the top of the car and the top of the hoistway to accommodate a person.

18. The method as claimed in claim 17, further comprising the step of:

enabling the sensing arrangement when the elevator car is at a landing below an uppermost landing.

19. The method as claimed in claim 14, further comprising the step of:

generating a position signal for disabling said sensing arrangement as the sensing arrangement is approached by the car.

20. The method as claimed in claim 14, further comprising the step of:

preventing, immediately, any further upward movement of the car upon detection of an unauthorized person on top of the car.

21. The method as claimed in claim 14, further comprising the step of:

activating, automatically, a physical safety device upon detection of an unauthorized person on top of the car.

22. The method as claimed in claim 14, further comprising the steps of:

emitting selected radiation; and detecting the emitted radiation thereby to detect the presence of an object in the path of the radiation.

23. A method of preventing injury to a person riding on top of an elevator car in a low-overhead elevator system, the method comprising the steps of:

distinguishing between an object riding on top of the car and the car itself;

detecting the presence of the object on top of the car, at a predetermined vertical point of the hoistway, as the car approaches the top of a hoistway using a sensing arrangement provided in the hoistway;

making a time measurement when the car has passed the predetermined point; and limiting further upward movement of the car when the object is detected if the sensing arrangement detects an object before it would be expected for the car itself to be detected.

24. An elevator system comprising:

a hoistway;

an elevator car situated to travel vertically within the hoistway;

a sensing arrangement provided in the hoistway, wherein the sensing arrangement detects the presence of an object on top of the car at a predetermined vertical point of the hoistway as the car approaches a top of the hoistway, wherein said predetermined vertical point is within a normal travel range of the elevator car; and means for making a time measurement when the car has passed the predetermined point, wherein the elevator system: (a) limits further upward movement of the car in the event that an object is detected at the predetermined vertical point before it would be expected for the car itself to be detected; and (b) distinguishes between an object riding on top of the car and the car itself having traveled to said point during normal operation.

* * * * *